US006626148B1

(12) United States Patent
Cooke et al.

(10) Patent No.: US 6,626,148 B1
(45) Date of Patent: Sep. 30, 2003

(54) FUEL PUMP

(75) Inventors: Michael Peter Cooke, Gillingham (GB); John Roderick Jefferson, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 138 days.

(21) Appl. No.: 09/645,128

(22) Filed: Aug. 24, 2000

(30) Foreign Application Priority Data

Aug. 27, 1999 (GB) ..... 9920210

(51) Int. Cl.[7] ..... F02M 37/04
(52) U.S. Cl. ..... 123/447; 123/467; 417/499
(58) Field of Search ..... 123/447, 467, 123/500, 501, 495; 137/493.8; 417/571, 499, 494

(56) References Cited

U.S. PATENT DOCUMENTS

| | | | | | |
|---|---|---|---|---|---|
| 2,055,578 | A | * | 9/1936 | Hurst | 123/447 |
| 2,138,849 | A | * | 12/1938 | Gambrell | 123/447 |
| 2,986,881 | A | * | 6/1961 | Moore | 123/447 |
| 3,667,438 | A | * | 6/1972 | Moulin et al. | 123/447 |
| 4,401,082 | A | * | 8/1983 | Leblanc | 123/447 |
| 4,591,321 | A | * | 5/1986 | Devaux | 417/499 |
| 4,784,322 | A | * | 11/1988 | Daly | 239/89 |
| 5,094,599 | A | | 3/1992 | Budecker | 417/534 |
| 5,724,863 | A | * | 3/1998 | Kramer et al. | 74/583 |
| 5,836,349 | A | * | 11/1998 | Kimberly et al. | 137/493.8 |
| 6,112,727 | A | * | 9/2000 | Cristiani et al. | 123/514 |
| 6,231,323 | B1 | * | 5/2001 | Jezek | 417/567 |

FOREIGN PATENT DOCUMENTS

| | | |
|---|---|---|
| DE | 8217666 | 11/1951 |
| DE | 19811087 | 9/1998 |
| EP | 0905374 | 3/1999 |
| FR | 837087 | 6/1960 |

* cited by examiner

*Primary Examiner*—Carl S. Miller
(74) *Attorney, Agent, or Firm*—Thomas N. Twomey

(57) ABSTRACT

A fuel pump comprising a plunger member reciprocable within a plunger bore, wherein the plunger member is cooperable with a drive arrangement to cause inward movement of the plunger member within the plunger bore to increase fuel pressure therein. The pump comprises an accumulator for fuel, and a valve arrangement controlling communication between the plunger bore and the accumulator to permit fuel under pressure to flow into the accumulator. The pumping plunger is moved in an outward direction under the action of the fuel pressure within the accumulator. The invention also relates to a fuel injection system comprising the fuel pump.

21 Claims, 4 Drawing Sheets

FUEL PUMP

TECHNICAL FIELD

The invention relates to a fuel pump and, in particular, a fuel pump for use in supplying fuel under high pressure to a fuel injection system.

BACKGROUND OF THE INVENTION

Commonly, a common rail fuel system is used to supply fuel under high pressure to a plurality of fuel injectors for injection into the associated engine, the common rail being charged with fuel at high pressure by means an appropriate high pressure fuel pump. Typically, the pump comprises a pumping plunger which is reciprocable within a plunger bore, movement of the pumping plunger within the plunger bore being controlled by means of a cam arrangement including a cam member and a roller. The plunger bore is supplied with fuel from a low pressure pump, movement of the roller over the surface of the cam member resulting in inward movement of the pumping plunger within the bore to reduce the volume of the plunger bore, thereby increasing fuel pressure therein. The pumping plunger has an associated spring which serves to bias the pumping plunger towards its outermost position such that, on completion of inward movement of the plunger member within the bore, the pumping plunger is returned to its outermost position under the force of the spring ready for the start of the next pumping sequence.

A disadvantage of this type of pump is that a large spring force is required to bias the pumping plunger outwardly following inward movement, particularly when the engine is running at relatively high speeds. For this purpose, a large, heavy-duty spring is required. This may require the use of a pump body of relatively large dimensions and may have an impact upon the dimensions of other components of the pump, and may increase the cost of the pump.

SUMMARY OF THE INVENTION

It is an object of the present invention to provide an alternative fuel pump which can be manufactured with reduced cost.

According to the present invention, there is provided a fuel pump comprising a plunger member reciproble within a plunger bore, the plunger member being cooperable with a drive arrangement to cause inward movement of the plunger member within the plunger bore to increase fuel pressure therein, the pump further comprising an accumulator for fuel, and a valve arrangement controlling communication between the plunger bore and the accumulator to permit fuel under pressure to flow into the accumulator, and wherein the pumping plunger is moved in an outward direction under the action of the fuel pressure within the accumulator.

The invention provides the advantage that, as fuel pressure within the accumulator serves to bias the pumping plunger outwardly within the plunger bore, the need for a large and expensive spring component is removed. The pump can therefore be manufactured with reduced cost.

Conveniently, the plunger bore and the plunger member define a pumping chamber for fuel. The fuel pump may include a first valve member, for controlling communication between an inlet chamber or passage and the pumping chamber, and a second valve member for controlling communication between the pumping chamber and the accumulator. Conveniently, the first and second valve members may take the form of annular plates.

The accumulator may include an accumulator chamber, defined within an accumulator housing. The accumulator chamber may be substantially coaxially aligned with the pumping chamber. In this way, the pump can easily be formed as a single unit to minimise space.

Preferably, the accumulator housing is engageable with a seating surface defined by a seating member, the accumulator housing and the seating member being arranged such that the accumulator housing disengages the seating surface, in use, when the pressure of fuel within the accumulator chamber exceeds a predetermined amount, so as to relieve fuel pressure within the accumulator chamber.

The plunger member may be associated with a piston member, a surface of the piston member being exposed to fuel pressure within the accumulator, the force applied to the surface due to fuel pressure within the accumulator causing outward movement of the plunger member within the bore. The piston member may be integrally formed with the plunger member or may be a separate component.

Conveniently, the drive arrangement takes the form of a cam arrangement.

The plunger member is arranged to be driven in a forward direction to pressurise fuel pressure within the plunger bore. Preferably, the cam arrangement includes a cam member defining first and second cam surfaces, the first and second cam surfaces being shaped to provide a driving force to the plunger member in the forward direction for a prolonged period of time. By shaping the cam surfaces to have different forms, the period of time for which the driving force is applied to the plunger member can be increased and the driving torque can be minimised.

The accumulator may supply fuel directly to a fuel injection system, for example a plurality of fuel injection units, such that the need for a separate supply line or common rail is removed. This reduces the cost of the fuel system.

BRIEF DESCRIPTION OF THE DRAWINGS

The invention will now be described, by way of example only, with reference to the following figures in which.

DESCRIPTION OF THE PREFERRED EMBODIMENT

Figure 1:
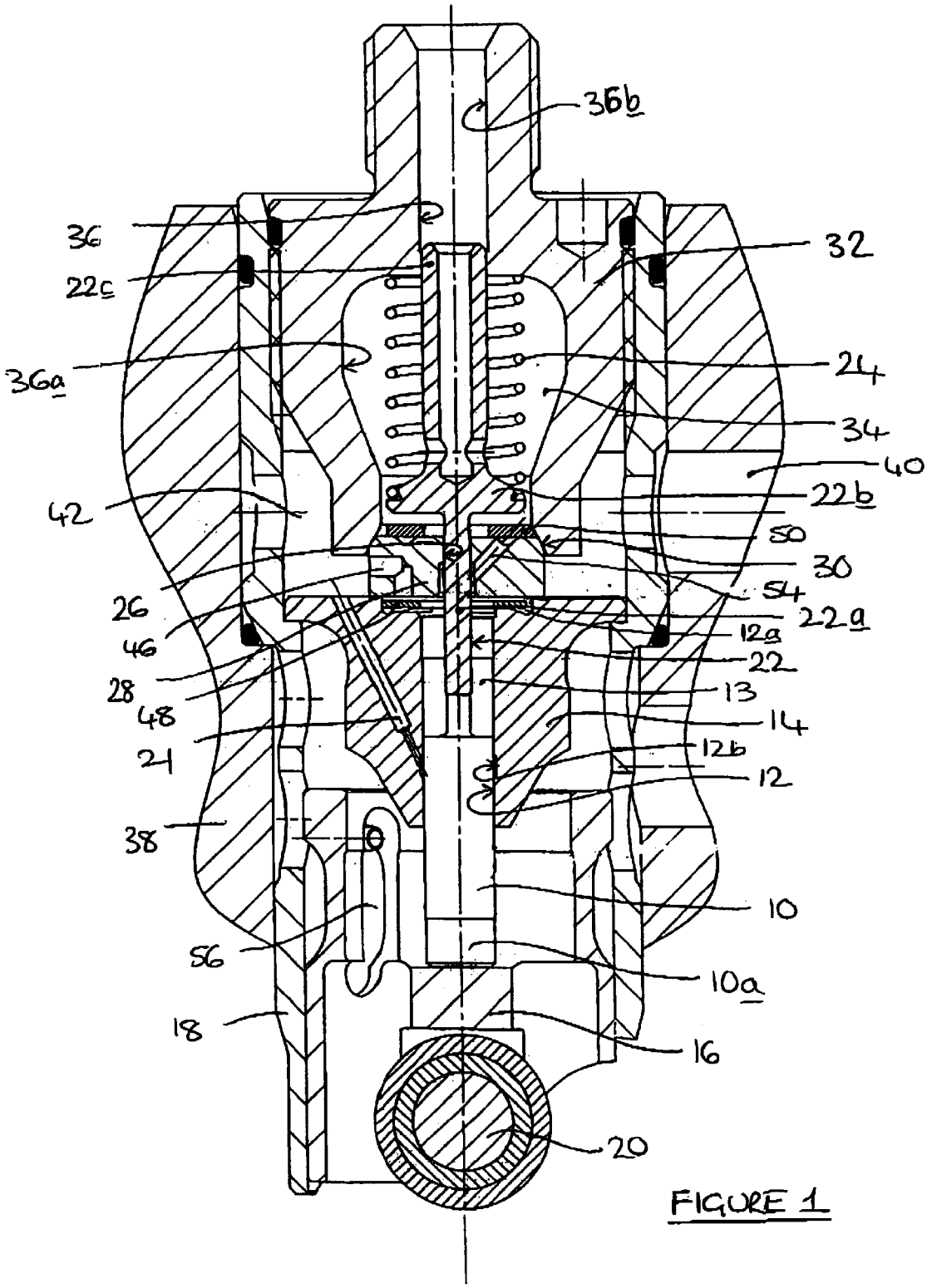
FIG. 1 is a sectional view of a fuel pump in accordance with an embodiment of the present invention.

Referring to FIG. 1, the fuel pump of the present invention includes a plunger member 10 which is reciprocable within a bore 12 provided in a first pump housing 14, the bore 12 and an end surface of the plunger member defining, in part, a pumping chamber 13. At the end of the plunger member 10 remote from the pumping chamber 13, the plunger member 10 includes an end region 10*a* which engages a tappet member 16, the tappet member 16 being moveable within a second pump housing 18 under the action of a roller member 20. The roller member 20 is cooperable with a cam surface of a cam arrangement (not shown), the cam arrangement being driven by means of an engine drive shaft such that, in use, the roller member 20 is caused to ride over the cam surface and impart an inward force (in an upwards direction in the view shown in FIG. 1) to the tappet member 16. As the tappet member 16 is engaged with the end region 10*a* of the plunger member 10, inward movement of the tappet member 16 is transmitted to the plunger member 10, thereby causing the plunger member 10 to move inwardly within the bore 12.

The bore 12 includes an enlarged diameter region 12*b* which communicates with a restricted drilling 21 provided in the housing 18 such that, in the event that fuel leaks past the plunger member 10 from the pumping chamber 13, the leakage fuel is returned through the drilling 21 to the inlet chamber 42. The provision of such an arrangement is advantageous in that engine oil can be used to lubricate the tappet member 16 for movement without a significant quantity of fuel mixing with the engine oil.

The plunger member 10 is engaged with a piston member 22, the piston member 22 including a lower region 22*a* having a diameter less than the diameter of the plunger member 10, an intermediate, enlarged region 22*b* and an upper end region 22*c*. The enlarged region 22*b* of the piston member 22 is engaged with one end of a light compression spring 24. The region 22*a* of the piston member 22 is slidable within a through bore 26 provided in a seating member 28, the diameter of the region 22*a* being substantially the same as the adjacent part of the bore 26 so as to guide sliding movement of the region 22*a* within the bore 26.

The seating member 28 is in abutment with the housing 14, the surface of the seating member 28 remote from the housing 14 defining a seating surface 30 which engages an accumulator housing 32. The accumulator housing 32 is provided with a through bore 36 including an enlarged diameter region 36*a* and a smaller diameter region 36*b*, the enlarged diameter region 36*a* defining an accumulator chamber 34 which houses the compression spring 24. The region 22*c* of the piston member 22 is slidable within the bore region 36*b*, the diameter of the bore region 36*b* being substantially the same as the diameter of the region 22*c* of the piston member 22 such that the bore region 36*b* also serves to guide sliding movement of the piston member 22. In this way, the length of the region 22*a* of the piston member 22, which also guides sliding movement of the piston member 22, need only be relatively small. The region 22*c* of the piston member 22 defines a fuel flow passage whereby fuel is able to flow from the accumulator chamber 34 to an outlet defined by an end of the bore region 36*b*.

The end of the compression spring 24 remote from the region 22*b* of the piston member 22 abuts a step defined by the bore 36, the spring 24 serving to bias the piston member 22 and the plunger member 10 in an outwards direction (downwards in the view shown in FIG. 1), the spring 24 applying only a relatively low biasing force to the plunger member 10 in the outwards direction. The accumulator housing 32 is located within and is in screw threaded engagement with the pump housing 18, the pump housing 18 being received within a part 38 of an engine housing.

The part 38 and the housing 18 are arranged to define an annular inlet passage 40 which permits fuel from a low pressure fuel pump or fuel reservoir (not shown) to flow into an annular inlet chamber 42.

The upper surface of the housing 14 is provided with a recess 12*a* which communicates with the pumping chamber 13, the seating member 28 being provided with a plurality of passages 46 (only one of which is shown in FIG. 1) which communicate with the recess 12*a* to permit fuel within the inlet chamber 42 to flow into the recess 12*a*. An inlet valve member 48 is located within the recess 12*a*, the inlet valve member 48 being engageable with a seating defined by the lower surface of the seating member 28 to control fuel flow between the inlet chamber 42 and the recess 12*a* such that, when the inlet valve member 48 is open, fuel delivered to the inlet chamber 42 is able to flow, via the passages 46, into the recess 12*a* and into the pumping chamber 13. When there is no, or only a limited fuel pressure difference between the pumping chamber 13 and the inlet chamber 42, the inlet valve member 48 adopts an open position, in which it is spaced from the seating defined by the lower surface of the seating member 28 to permit fuel to flow from the inlet chamber 42 into the recess 12*a* and the pumping chamber 13. When the pressure within the pumping chamber 13 is increased, the net force on the valve member 48 urges the valve member 48 towards a position in which it closes the passages 46 breaking communication between the pumping chamber 13 and the inlet chamber 42.

An outlet valve member 50 is located within the accumulator chamber 34, the outlet valve member 50 being engageable with a seating defined by the upper surface of the seating member 28 to control fuel flow between the pumping chamber 13 and the accumulator chamber 34. The seating member 28 is provided with a plurality of drillings 54 which communicate with an annular groove such that, when the outlet valve member 50 is lifted away from the seating defined by the upper surface of the seating member 28, fuel is able to flow from the pumping chamber 13 into the accumulator chamber 34, engagement of the valve member 50 with the seating member 28 breaking such communication. The position adopted by the outlet valve member 50 is dependent upon the fuel pressures within the pumping and accumulator chambers 13, 34, and the areas of the member 50 exposed to those pressures.

Figure 2:
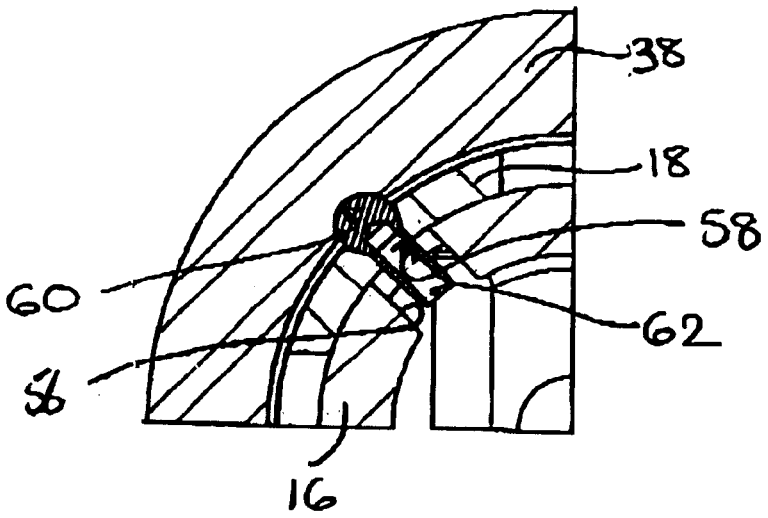
FIG. 2 is an enlarged sectional view of a part of the fuel pump in FIG. 1.

As indicated in FIG. 2, the housing 18 is provided with a drilling 58, the tappet member 16 being provided with an elongate aperture or slot 56. The drilling 58 provided in the housing 18 is aligned with a recess 60 provided in the part 38, the drilling 58 and the recess 60 being arranged to receive a pin member 62 which extends through the slot 56 and serves to prevent angular movement of the tappet member 16 relative to the part 38, thus ensuring that the axis of rotation of the roller member 20 remains substantially parallel to that of the cam.

In use, starting from a position in which the plunger member 10 occupies its outermost position within the plunger bore 12, fuel is delivered to the inlet chamber 42 through the inlet passage 40 from the low pressure fuel pump. During this stage of operation, as there is only low fuel pressure within the pumping chamber 13, the inlet valve member 48 is in its open position, spaced away from the seating defined by the lower surface of the seating member 28, such that fuel within the inlet chamber 42 is able to flow, via the passages 46, into the recess 12*a* and into the pumping chamber 13, charging the pumping chamber 13 to a low pressure.

From this position, movement of the cam causes the roller member 20 to move over the cam surface, and the tappet member 16 is moved axially within the housing 18, thereby imparting axial movement to the plunger member 10 within the bore 12 to reduce the volume of the pumping chamber 13. Fuel pressure within the pumping chamber 13 is thereby increased and a point will be reached when fuel pressure within the pumping chamber 13 is sufficient to close the inlet valve. Continued movement of the plunger member 10 pressurises the fuel within the pumping chamber, and subsequently the pressure will rise to a level sufficient to urge the outlet valve member 50 away from its seating, defined by the upper surface of the seating member 28, against the action of the fuel pressure within the accumulator chamber 34, and fuel under high pressure is able to flow into the accumulator chamber 34.

As fuel pressure within the accumulator chamber 34 increases, the force applied to the outlet valve member 50 due to fuel pressure within the chamber 34 increases and serves to urge the outlet valve member 50 towards the seating defined by the upper surface of the seating member 28. A point will be reached when the outlet valve member 50 moves against the seating to close communication between the pumping chamber 13 and the accumulator chamber 34, this point occurring shortly after the roller member 20 has ridden over the peak of the cam. Fuel under high pressure within the accumulator chamber 34 acts on the exposed parts of the piston member, the effective area of the exposed parts being sufficient to apply a force to the piston member urging the piston member 22 in an outwards direction (downwards in the view shown in FIG. 1). The piston member 22 thereby imparts movement to the plunger member 10 to return the plunger member 10 to its outmost position within the bore 12 ready for the next pumping cycle. The accumulator chamber 34 therefore provides an accumulator volume for fuel, fuel pressure within the accumulator volume acting on the piston member 22 to bias the plunger member 10 towards its outermost position. Thus, there is no need to provide a large spring within the chamber 34, the light spring 24 being required to bias the piston member 22 and the plunger member 10 in an outwards direction upon engine start-up when the fuel pressure within the accumulator chamber 34 is relatively low. The pump can therefore be manufactured at a relatively low cost.

Fuel under high pressure from the accumulator volume is delivered to the remainder of a fuel injection system, for example to the common rail and injectors of a common rail fuel system.

It will be appreciated that, following engine start-up while the engine is still running at a relatively low speed, the fuel pressure within the accumulator chamber 34 may not increase to an amount which is sufficient to return the plunger member 10 to its outermost position within the plunger bore 12. However, during this stage of operation, the relatively low force of the spring 24 is sufficient to urge the plunger member 10 outwardly, ready for the next pumping cycle.

The inlet and outlet valve members 48, 50 conveniently take the form of large diameter annular plates, an opening being provided through the center of each valve member 48,50 to permit fuel flow into the pumping chamber 13 or the accumulator chamber 34 respectively when the respective valve member 48, 50 is lifted away from its seating. The outer peripheries of the inlet and outlet valve members 48, 50 are conveniently also provided with slots, flats or grooves to permit fuel to flow between the inlet chamber 42 and the pumping chamber 13, and between the pumping chamber and the accumulator chamber 34 at a sufficiently high rate.

The accumulator housing 32 and the seating member 28 may be arranged such that, when fuel pressure within the accumulator chamber 34 exceeds a predetermined amount, the wall of the bore 36 provided in the accumulator housing 32 dilates and, in addition, the seating member 28 is compressed. The accumulator housing 32 therefore disengages the surface 30 defined by the seating member 28 to permit fuel within the accumulator chamber 34 to flow into the inlet chamber 42, thereby reducing fuel pressure within the chamber 34. This prevents damage being caused to the pump and the engine due to an excessive increase in fuel pressure within the accumulator chamber 34, without requiring the provision of a separate pressure relief valve.

Figure 3:
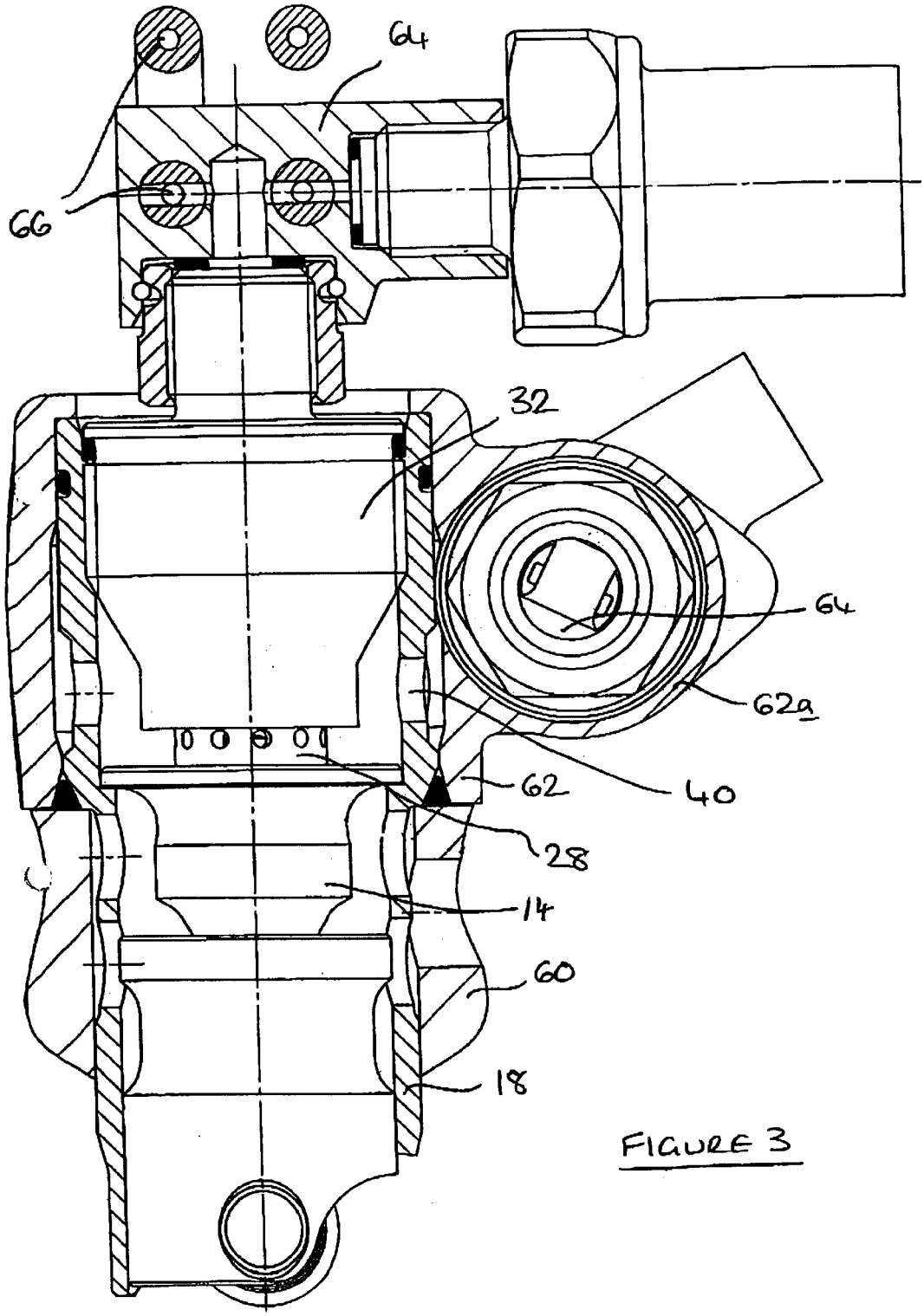
FIGS. 3 and 4 are sectional views of a fuel pump in accordance with alternative embodiments.

The part 38 shown in FIG. 1 may form part of the engine cylinder head or part of the engine block. Referring to FIG. 3, in an alternative embodiment of the invention the housing 18 is received within a first housing 60 and a second housing 62, the housing 62 including a projection 62*a* housing fuel inlet passages 64 which communicates with the inlet passage 40 defined, in part, by the housing 18. The provision of the housing 62, including the projection 62*a* for the fuel inlet passages 64, removes the need to integrate a fuel inlet passage into the engine block, thereby reducing the cost of the engine. The embodiment of the invention shown in FIG. 3 also includes a fuel distribution manifold 64 which permits fuel under high pressure within the accumulator chamber 34 to be delivered directly to inlet passages 66, four of which are shown in FIG. 3, for delivery to associated fuel injection units. In this way, the need for a separate common rail which supplies fuel under high pressure to the fuel injection units is removed.

Figure 4:
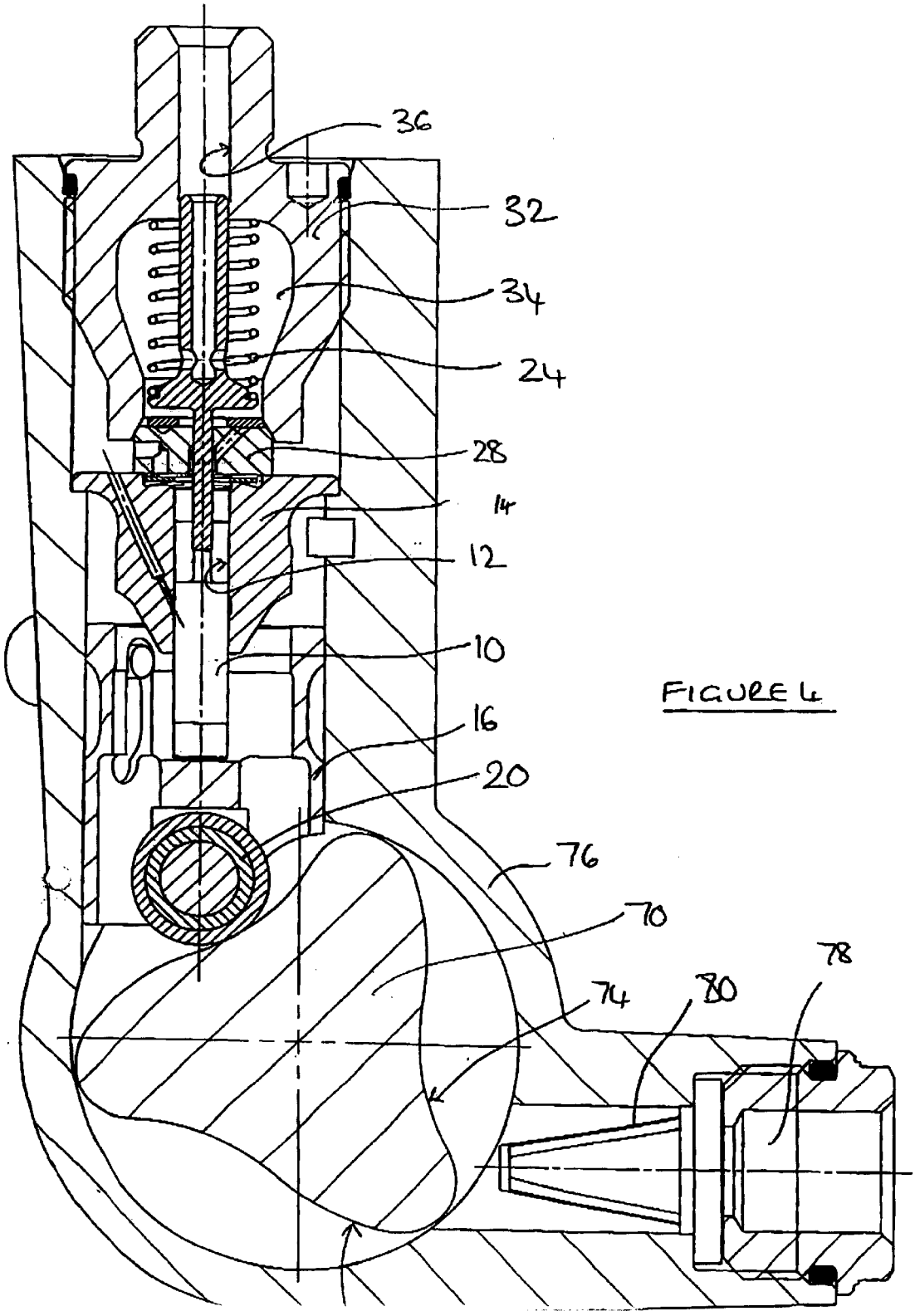

FIG. 4 shows a further alternative embodiment of the invention, with similar parts to those shown in FIGS. 1 to 3 being denoted with the same reference numerals. FIG. 4 shows the cam arrangement which includes a cam member 70 which defines cam surfaces 72, of relatively shallow rising form, and cam surfaces 74 of steeper falling form, the roller member 20 riding over the cam surfaces 72, 74 to impart axial movement to the tappet member 16 and, hence, the plunger member 10 within the bore 12. By using a cam member 70 including cam surfaces 72, 74 of different form, the period of time for which the roller member 20 drives the tappet member 16 inwardly can be increased whilst minimising the driving torque. Conventionally, when a spring force is used to return the plunger member 10 outwardly following fuel compression, it is not possible to extend the pumping period in this way for relatively high engine speeds. However, it is made possible by the present invention in which the plunger member 10 is returned to its outermost position by means of fuel pressure within the accumulator chamber 34.

In the embodiment shown in FIG. 4, the tappet member 16, the housing 14, the seating member 28 and the accumulator housing 32 are housed within an outer housing 76, the outer housing 76 also housing the cam member 70 and an inlet passage 78 for fuel, fuel being delivered through the inlet passage 78 through a filter arrangement 80 to lubricate the tappet member 16 within the housing 76. The filter arrangement 80 ensures dirt and other debris which may be carried by fuel delivered through the inlet passage 78 does not reach the components of the pump or the parts of the fuel injection system.

It will be appreciated that the pump of the present invention may be housed directly within the engine block, or may be mounted within the cylinder head of the associated engine.

What is claimed is:

1. A fuel pump comprising a plunger member reciprocable within a plunger bore, the plunger member being cooperable with a drive arrangement to cause inward movement of the plunger member within the plunger bore to increase fuel pressure therein, the pump further comprising an accumulator for fuel, the accumulator having an accumulator housing defining an accumulator chamber, and a valve arrangement controlling communication between the plunger bore and the accumulator to permit fuel under pressure to flow into the accumulator, wherein the accumulator housing is engageable with a seating surface defined by a seating member, the accumulator housing and the seating member being arranged such that the accumulator housing disengages the seating surface, in use, when the pressure of fuel within the accumulator chamber exceeds a predetermined amount, so as to relieve fuel pressure within the accumulator chamber, and wherein the pumping plunger is moved in an outward direction under the action of the fuel pressure within the accumulator.

2. The fuel pump as claimed in claim 1, wherein the plunger bore and the plunger member define a pumping chamber for fuel.

3. The fuel pump as claimed in claim 2, comprising a first valve member for controlling communication between an inlet chamber and the pumping chamber, and a second valve member for controlling communication between the pumping chamber and the accumulator.

4. The fuel pump as claimed in claim 3, wherein the first and second valve members take the form of annular plates.

5. A fuel pump as claimed in claim 1, wherein the accumulator chamber is substantially coaxially aligned with the pumping chamber.

6. The fuel pump as claimed in claim 1, wherein the plunger member has an associated piston member, a surface of the piston member being exposed to fuel pressure within the accumulator, the force applied to the surface of the piston member causing outward movement of the plunger member within the plunger bore.

7. The fuel pump as claimed in claim 6, wherein the piston member is integrally formed with the plunger member.

8. The fuel pump as claimed in claim 1, wherein the drive arrangement takes the form of a cam arrangement.

9. The fuel pump as claimed in claim 8, whereby, in use, the plunger member is driven in a forward direction to pressurise fuel pressure within the plunger bore, the cam arrangement including a cam member defining first and second cam surfaces, the first and second cam surfaces being shaped to provide a driving force to the plunger member in the forward direction for a prolonged period of time.

10. The fuel pump as claimed in claim 1, comprising a tappet member in engagement with the plunger member, the tappet member being driven, in use, by the drive arrangement to transmit movement to the plunger member, the tappet member, the plunger member and the drive arrangement being housed within a housing defining an inlet passage for delivering fuel to the tappet member, in use, to lubricate the tappet member.

11. A fuel injection system comprising at least one fuel injection unit and a fuel pump as claimed in claim 1, wherein the accumulator of the fuel pump is arranged to supply fuel directly to the or each fuel injection unit.

12. A fuel pump, as set forth in claim 1, further comprising a compression spring coupled to the plunger member to cause outward movement of the plunger member within the plunger bore upon start-up of the fuel pump.

13. A fuel pump, as set forth in claim 12, wherein the plunger bore and the plunger member define a pumping chamber for fuel.

14. A fuel pump, as set forth in claim 13, further comprising a first valve member for controlling communication between an inlet chamber and the pumping chamber, and a second valve member for controlling communication between the pumping chamber and the accumulator.

15. A fuel pump, as set forth in claim 14, wherein the first and second valve members are annular plates.

16. A fuel pump, as set forth in claim 13, wherein the accumulator chamber is substantially co-axially aligned with the pumping chamber.

17. A fuel pump, as set forth in claim 12, wherein the plunger member has an associated piston member, a surface of the piston member being exposed to fuel pressure within the accumulator, the force applied to the surface of the piston member causing outward movement of the plunger member within the plunger bore.

18. A fuel pump, as set forth in claim 17, wherein the piston member is integrally formed with the plunger member.

19. A fuel pump, as set forth in claim 12, wherein the drive arrangement takes the form of a cam arrangement.

20. A fuel pump, as set forth in claim 19, wherein the plunger member is driven in a forward direction to pressurize fuel pressure within the plunger bore, the cam arrangement including a cam member defining first and second cam surfaces, the first and second cam surfaces being shaped to provide a driving force to the plunger member in the forward direction.

21. A fuel pump, as set forth in claim 12, further comprising a tappet member in engagement with the plunger member, the tappet member being driven, in use, by the drive arrangement to transmit movement to the plunger member, the tappet member, the plunger member and the drive arrangement being housed within a housing defining an inlet passage for delivering fuel to the tappet member, in use, to lubricate the tappet member.

* * * * *